United States Patent [19]

Strauss

[11] 4,076,050

[45] Feb. 28, 1978

[54] SHED FORMING DEVICE ON AN UNDULATED SHED LOOM

[75] Inventor: Edgar Strauss, Agincourt, Canada

[73] Assignee: Ruti Machinery Works Ltd, Ruti, Switzerland

[21] Appl. No.: 635,401

[22] Filed: Nov. 26, 1975

[30] Foreign Application Priority Data

May 17, 1974 Switzerland ..... 6768/74

[51] Int. Cl.[2] ..... D03D 47/26

[52] U.S. Cl. ..... 139/436

[58] Field of Search ..... 139/436, 13, 16, 55

[56] References Cited

U.S. PATENT DOCUMENTS

| | | | |
|---|---|---|---|
| 2,799,295 | 7/1957 | Juillard et al. | 139/436 |
| 3,263,705 | 8/1966 | Rossmann | 139/436 |
| 3,640,314 | 2/1972 | Strauss | 139/436 |

*Primary Examiner*—Henry S. Jaudon

*Attorney, Agent, or Firm*—Donald D. Denton

[57] ABSTRACT

A shed forming device on an undulated shed loom in which heddles are arranged along flexible cables and held by them, and the cables during the operation of the loom carry out an undulantly advancing movement for the production of which drive points spaced apart from each other are provided on each cable.

13 Claims, 8 Drawing Figures

SHED FORMING DEVICE ON AN UNDULATED SHED LOOM

BACKGROUND OF THE INVENTION

The present invention relates to a shed forming device on an undulated shed loom in which, in operation, sheds form one behind the other in an undulated movement and the shed forming heddles are arranged along flexible cables and held by them, and the cables during the operation of the loom carry out an undulantly advancing movement for the production of which drive points spaced apart from each other are provided on each cable.

In undulated shed looms it is known to form the sheds over the width of the loom by means of groups of heddles. The successive groups carry out their shed forming movements with a difference in phase in the manner that, as a whole, they produce an undulating-like movement which is however divided up stepwise. In this operation it is necessary to equalize the different warp tensions present in the different groups in order to obtain a linear beating-up line in the fabric.

It is also known to arrange the heddles along wires, to bend the wires into an undulated shape, and to change the bends in such a manner that the undulated shape continuously advances. In this connection at the location of each wave bulge there is a shuttle which moves with its wave bulge. The movement of the wires is effected by helically twisted shafts over sliders moved by them and in combination with a back-pull device and therefore in a relatively extremely complicated manner. In another embodiment the wires are bent in undulated shape by shafts arranged alongside of each other. As a result of this arrangement the wires are deflected transversely to the direction of their wave movement, i.e. the heddles which normally lie in a plane come to lie on both sides of said plane at different distances from it.

SUMMARY OF THE INVENTION

The disadvantages in the arrangements set forth above are eliminated by the present invention. The present invention is characterized by the fact that for each cable there are provided individually movable lifter or operational members lying in a plane which extend in the width-wise direction of the loom, and for each movement of the drive points which occurs there is a correspondingly moved lift member, and each drive point is connected via a coupling with its corresponding lift member.

By the expression "cable" there is to be understood any elongated flexible body, for instance wire, rope, cord, reed, flexible rod, helix, and the like.

BRIEF DESCRIPTION OF THE DRAWINGS

These and other objects of the invention will now be explained in further detail with reference to illustrative embodiments and the accompanying drawings in which.

DESCRIPTION OF PREFERRED EMBODIMENTS

Figure 1:
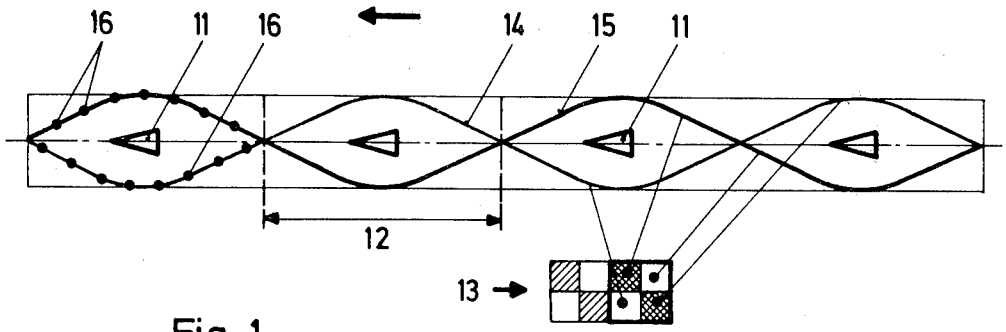
FIGS. 1 and 2 are schematic diagrams which show the manner of operation of the invention during weaving.
Figure 2:
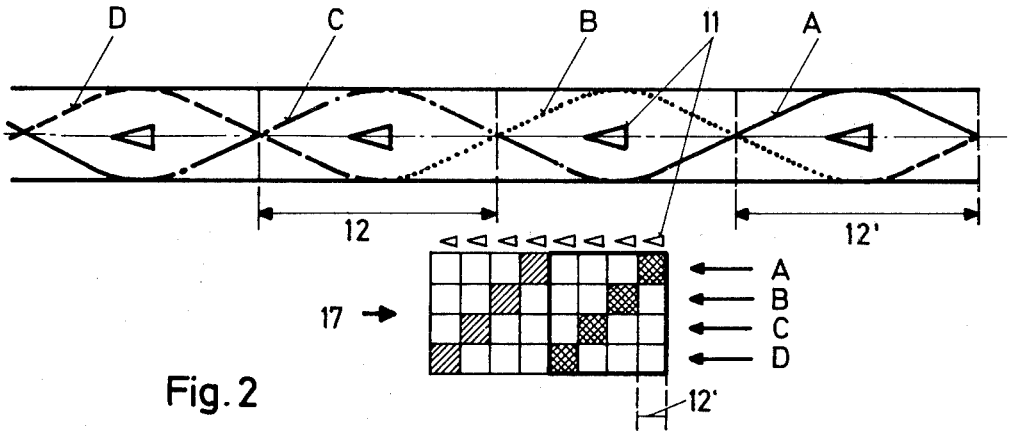

The main feature of multi-phase weaving consists in the simultaneous insertion of the filling by shuttles or filling carriers 11 which move forward in column form as illustrated in FIGS. 1 and 2.

In order to make possible the continuous binding-in of each individual filling thread, the warp threads must effect a change of shed between successive filling carriers 11. With the simplest two-thread foundation weave 1/1 or plain weave, it is sufficient for all warp-threads to be pulled into two rows of heddles, alternately with one thread each in the first and second rows respectively. Upon the opposite movement of the two rows of heddles all odd threads pass into the low shed position and all even threads into the high shed position, for instance within a given shuttle division 12, while the reverse takes place in the adjacent shuttle divisions. After the insertion of the filling thread, the shed is changed, all threads assuming the opposite position. In the diagram of the pattern repeat 13, a high shed warp thread is always characterized by a filled-in square. In FIG. 1 the curves or sinusoidal lines 14 and 15 represent schematically the position of the individual warp threads, a few individual warp threads 16 being shown individually for better understanding. The warp threads 16 extend transversely to the plane of the drawing. The curves 14, 15 can also be considered a showing of the eyes of the heddles.

Upon the forward movement of the filling carriers 11 in the direction indicated by the arrow this undulated warp-thread or heddle formation must carry out a movement of travel synchronously with the movement of the filling carriers 11. The crossing of the individual warp threads takes place between the filling carriers 11 at the point of interception of the sinusoidal lines 14, 15.

As example of a foundation weave of higher order, a four-thread weave 1/3 will also be considered. From the weave diagram 17 in FIG. 2 it can be noted that this weave requires at least four rows of heddles A, B, C, D and that every four successive threads (each thread of the weave repeat) must be capable being moved individually. In accordance with the repeat 17 in FIG. 2, commencing at the right, the first warp thread is connected with heddle row A, the second warp thread with heddle row B, etc. The fifth warp thread is again connected with heddle row A, the sixth again with heddles row B, etc. If, within a shuttle division 12 in accordance with the weave repeat, one of the heddle rows, for instance the heddle row A, is in the upper shed, then the other heddle rows B, C, D are in the lower shed; this is true in FIG. 2 for the shuttle division 12'. Transferred to the weave repeat diagram this shuttle division 12' corresponds to the first vertical column of the repeat diagram 17.

Figure 3:
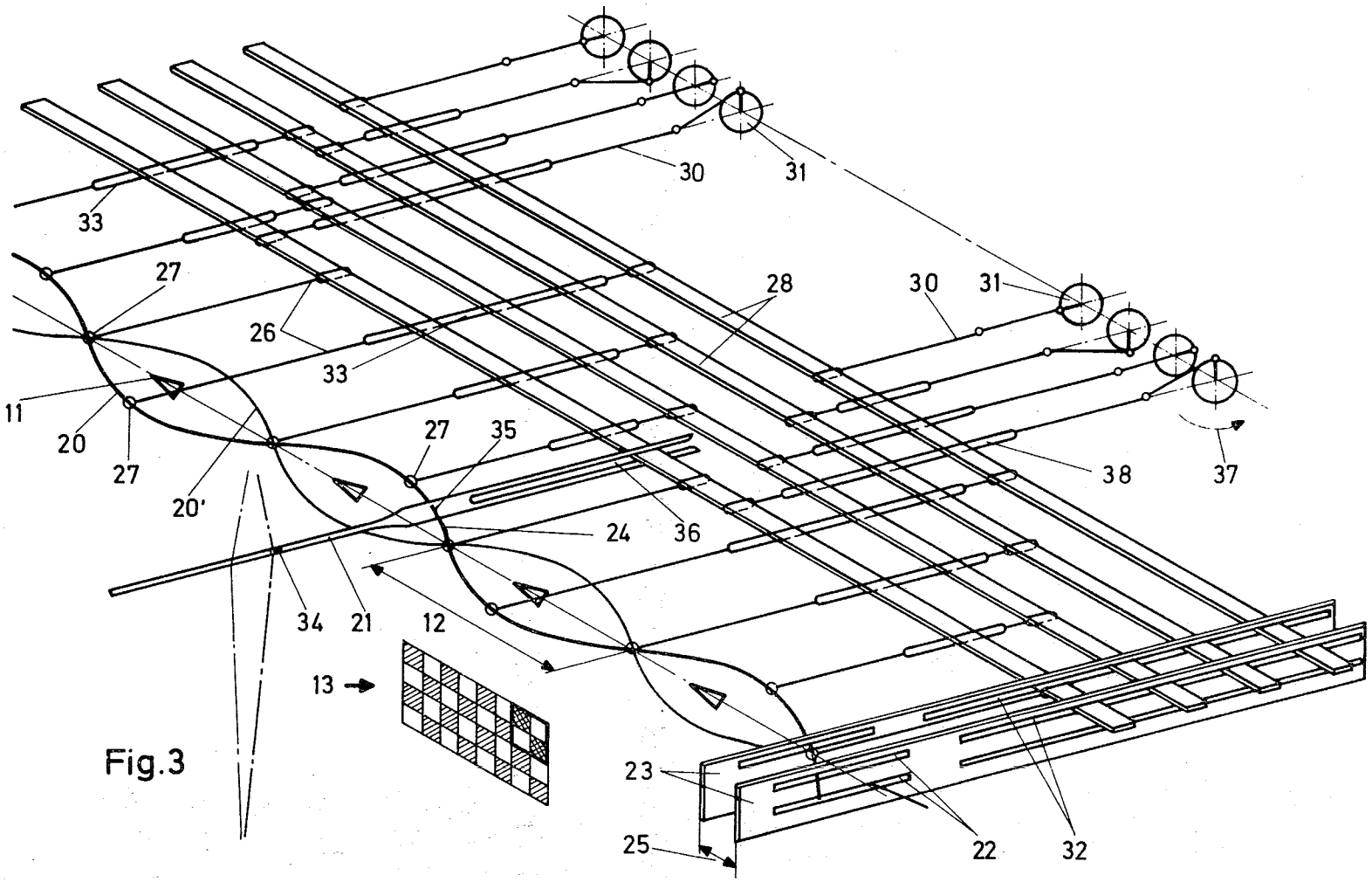
FIG. 3 shows a device in accordance with the invention for weaving a plain weave.

FIG. 3 shows an embodiment for the forming of a plain weave, i.e. a weave in accordance with the repeat diagram 13. The sinusoidal heddle-eye formation is produced by flexible cables 20, 20'. Along the cables 20, 20' there are arranged shed forming heddles 21, only a single heddle 21 being shown in combination with the cable 20 in FIG. 3. The cables 20, 20' serve as heddle carriers, in which connection the number of heddles can be correspondingly varied in accordance with the density of the warp threads. The drive of the heddles 21 is shown on basis of the flexible cable 20. This cable 20 is conducted through superimposed slots 22 of a plurality of large surface guide elements 23 which are arranged over the entire width of the loom, but only two of which are shown. Since escape towards the top or bottom is prevented by this slot guiding, the flexible cable 20 can be deformed only in a horizontal plane. The distance 25 from guide element 23 to guide element 23 is so selected that a relatively narrow free space is formed between them. In general, the distances amount to between about 3 and 8 mm. The heddles 21 placed in the intervening spaces therefore are imparted lateral guidance by the guide elements 23 and can thus slide away laterally only by a very insignificant amount on the ascending and descending flanks 24 of the flexible cable 20 due to the pull of the warp thread. With a spacing 25 of the guide elements 23 of for instance 5 mm. and with guide elements 23 of a thickness of 1 mm. said amount is less than 4 mm. even in the event that only a single heddle 21 is present between every two guide elements 23.

The flexible cable 20 is driven or deformed by connecting rods 26. Each connecting rod 26 is provided at its drive point 27 with a rounded eye through which the cable 20 extends freely movable in the longitudinal direction. The purpose of the rounding of the eye is to avoid damage to the cable by abrasion. Referred to the sinusoidal wave formed by the cables 20 the distance between adjacent drive points is 90°. On the other hand each connecting rod 26 or coupling means is moved by a rail-shaped lift member or operational member 28 and thus forms a coupling between the latter and the cable 20. The lift members 28 in their turn are actuated by further connecting rods 30. The drive of the latter is effected by the cranks 31. The lift members 28 are guided by slots 32 which are also arranged in the guide elements 23. In order to produce a plain weave, the cranks 31 are shifted in their cams by 90° from one crank to the next. They carry out half a revolution (180°) upon a full revolution of the main shaft of the loom, i.e. upon the movement of a shuttle 11 by one shuttle division 12.

The cable 20' is shown in the drawing as though it lay in the same plane as the cable 20. In fact the cables, however, are arranged one below the other. The cable 20' lies in the plane defined by the lower slots 22. It has a drive device corresponding to the members 26, 28, 30, and 31.

The connecting rods 26 are provided with slots 33 so that the lift members 28 can be bridged over where necessary. In this way they are moved past the rail-shaped lift members 28 in their immediate vicinity. Of course the rods 26 connected with the front-most lift member 28 do not require such slots. In this way the result can be obtained that all elements 26, 28, 30 for the actuating of the cable 20 lie in the same plane. Over the entire width of the loom, i.e. over the entire length of the lift members 28 there are provided at at least two places groups of cams having four cams which are 90° apart.

The heddles 21 are each provided with an eye 34 serving to guide the warp threads. They are held by the cable 20 by means of the openings 35. Due to the fact that they are arranged between the guide elements 23 they are secured against lateral shifting. The provision of the slot 36 furthermore makes it possible to fix the heddles 21 in their horizontal position by introducing the slot into at least the front-most lift member 28.

By the arrangement described there is obtained the essential advantage that the heddles 21 and elements 26, 38, 30, 31 associated with the cable 20 all lie in one and the same plane. The same applies in analogous manner for the cable 20'. In this way the rows of heddles belonging to the cable 20 and the rows of heddles belonging to the cable 20' can be arranged close to each other and the difference in path of the two rows of heddles which is necessary for the formation of the shed and the lateral distance between said rows correspond fundamentally to the conditions present in conventional looms.

Upon the operation of the loom, the cams rotate in the direction indicated by the arrow 37. The process which takes place in this connection on the cables can be noted from FIG. 4. With the crank positions shown of 0°, 90°, 180°, and 270°, the flexible cable is deformed into a sinusoidal line 40 over its entire length. After a 45° rotation of the cam 31 the cable assumes the shape 42 shown in FIG. 4, etc. The production of the curved shapes 41 and 42 can best be noted when taking into account movements of the drive points 27 caused by the crank 31, in accordance with FIG. 3. The result is that due to the drive shown in the drawing, the cable 20 forms a progressive sinusoidal line. All connecting rods 26 of the same phase of one row of heddles are associated with a common lift member 28. Each of the four lift members is driven independently via at least two cam arms by two cranks parallel to each other. Passage slots 38 provided in the connecting rods 30 make it possible for the lift bars 28 to carry out relative movements without interference.

For the cable 20' there exist conditions analogous to those described, there being of course a phase difference of 180° with respect to the cable 20. An approximately geometrically accurate sinusoidal curve shape of the flexible cable can be obtained by taking into account the following factors: The most favorable number of drive points 27 per shuttle division 12; and the properties of the flexible cable 20, for instance elasticity, bending strength, diameter, etc.

Figure 4:
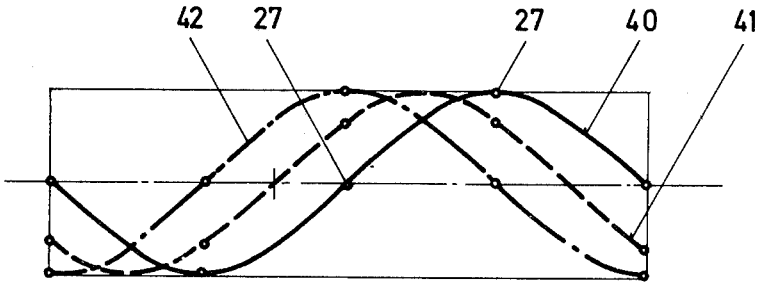
FIG. 4 is a further diagram explaining the manner of operation of the invention during weaving.

An elasticity of the flexible cable contributes to maintaining as constant as possible a crest curvature of the shape of the sinusoidal curve, in particular in the 45° phase position of the cams (see curve 41 in FIG. 4). In practice, a high grade polyamide-coated steel wire cable of a diameter of about 4 mm. has proven suitable for this.

Figure 5:
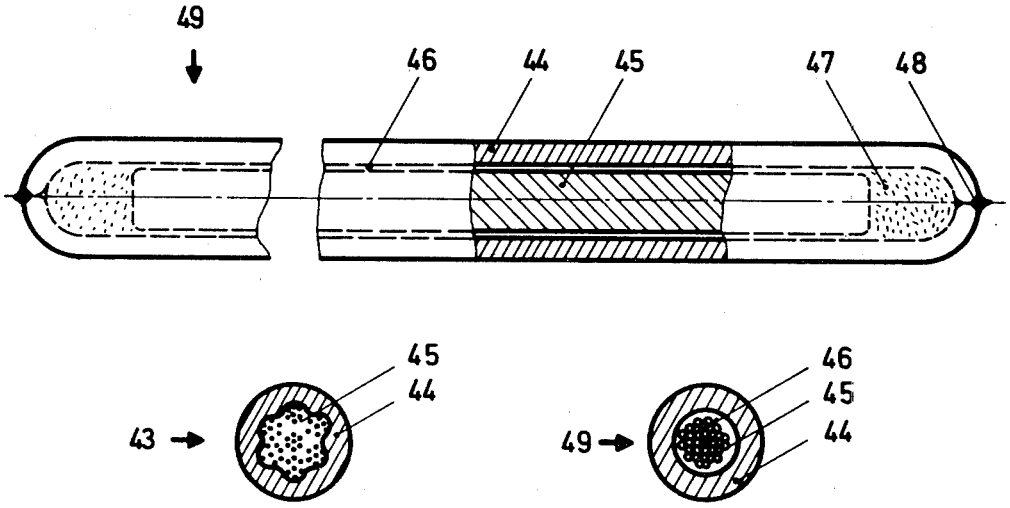
FIG. 5 shows examples of flexible cables.

Examples of flexible cables 20 are shown in FIG. 5. As shown in the embodiment 43, a steel rope 45 surrounded by a plastic jacket 44 can be provided.

Adherence between the coating 44 and the steel center 45 prevents relative movement between the steel rope 45 and the jacket 44. Therefore a particularly advantageous embodiment 49 consists of a steel-rope center 45 which is pulled into a plastic tube 44. Since the center 45 and the jacket 44 are now separated at 46, no adherence occurs between the two parts upon the bending. Relative displacements can take place whereby the bending movements can occur very easily. In order still further to reduce the internal friction and to prevent internal fretting corrosion of the steel rope 45, the rope can furthermore be previously provided with an anti-rust lubricant 47. The jacketing 44 is in this case sealed off at both ends 48, for instance by heat sealing, after the anti-rust agent and lubricant have been introduced.

Figure 6:
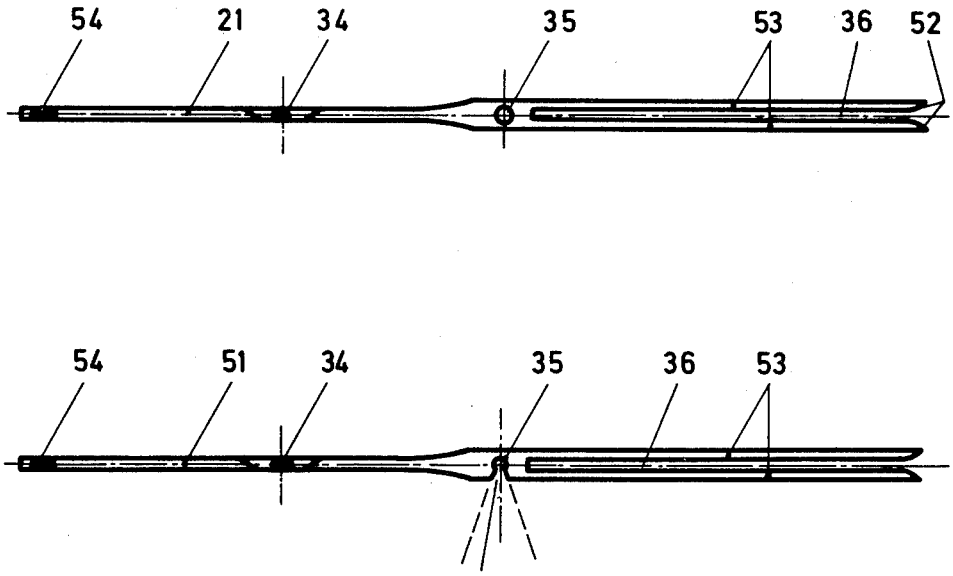
FIG. 6 shows examples of heddles.

FIG. 6 shows two different types of shed forming heddles 21 and 51. Both the heddle 21 and the heddle 51 have a thread eye 34, a slot 36 formed by two fork arms 53 and an opening 54 which is used in the preparation for weaving. The fork arms 53 are advantageously rounded outward at their free ends 52 so that the lift members 28 can move unimpeded into the slot. The heddle 21 has a round hole 35 through which the flexible cable 20 is drawn. In contradistinction to this, the heddle 51 has a wedge-shaped open incision 55 by means of which it is fastened to the flexible cable 20. The provision of an incision 55 has the advantage that the heddles can be replaced individually while, when a hole 35 is present, they must be pushed in along the cable 20 but on the other hand are held more reliably.

Figure 7:
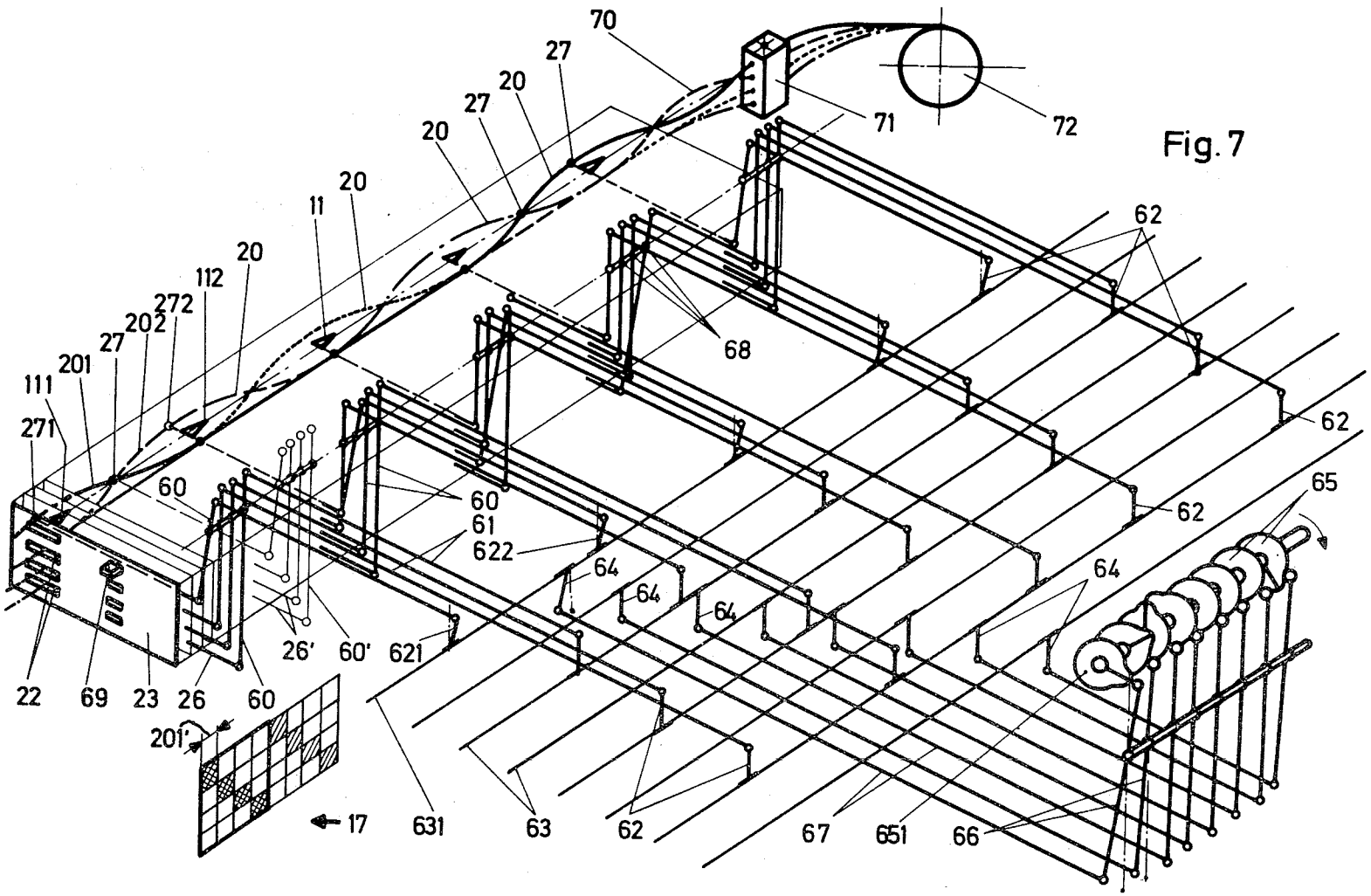
FIG. 7 shows a diagrammatic illustrative example for the weaving of a complicated design.

A further illustrative embodiment will be described with reference to FIG. 7. This embodiment is intended to show that the present invention makes it possible to produce different types of weaves on an undulated loom. The example concerns the four-thread weave 1/3 already shown in FIG. 2. Four different flexible cables 20 are provided. In order that the manner of operation may be clearly noted, the cables 20 have again been shown in the drawing as though they were in the same plane, as was done in FIG. 3. Actually, however, they are arranged in four different planes which are defined by the slots 22 arranged in the guide elements 23. This fact is indicated by the diagram on the left-hand side of FIG. 7 in the manner that the ends of the four cables 20 are drawn in the four planes in accordance with the actual conditions. Each of the cables 20 has drive points 27 which, referred to the sinusoidal shape of the cables 20, are located with a phase shift of 90° apart. Along each cable 20 there are arranged heddles (not shown), the horizontal guiding of which is provided by rails 69 only one of which has been shown and which come to rest between the arms 53 of the heddles (FIG. 6). Guide elements 23 are again provided for the lateral guiding of the heddles.

At each drive point 27 of the cables 20, one end of a connecting rod 26 is connected. The other end of each connecting rod 26 is connected via a double-armed lever 60 and another connecting rod 61 to an arm 62 which form a coupling means which is fastened to a rotary shaft 63. When the shafts 63 are rotated, the arms 62 are swung. In order to turn the shafts 63 there are provided the further arms 64 which are actuated in the manner shown in FIG. 4 by cams 65 via double-armed levers 66 and further connecting rods 67.

In order to obtain a clean opening of the shed, the flexible cables 20 must, upon the formation of the shed, move over a path which is longer the further away they are from the shuttles or the place of the beating-up of the cloth, i.e. the dash-dot line cable 20 has to move over the largest distance and the solid line cable 201 the smallest distance. With the arrangement shown the lower arm of the double-armed levers 60 which is swingable about the fulcrums 68 and serves for the actuation of the dash-dot line cable 20 is the longest and the lower arm of the lever 60 for the actuating of the solid line cable 201 is the shortest while the upper lever arms are all of the same length. Thus by a suitable selection of the arm lengths of the levers 60 a so-called "clean shed" can be obtained. Furthermore, a single steering shaft 63 is also able to drive all arms 62 of any heddle rows which in accordance with the pattern repeat are to carry out the same lift movement.

The cams 65 and 45° apart in the case of this 1/3 weave, whereby a sufficient division of the sinusoidal line to produce a traveling undulated shed is present. The speed ratio between the cam shaft and the machine shaft is 1:4. In this connection it should be mentioned that in FIG. 7, for greater clarity, the connecting rods 61 and arms 62 associated with every second cam 65 have not been shown and that the corresponding double-arm levers 60' and connecting rods 26' have been shown only once.

During a full revolution of the main shaft of the loom each shuttle moves from the position shown in the drawing to its next position. During such an operating period the shuttle 111 must, in accordance with the first vertical column 201' of the draft repeat 17, fine in the upper shed the warp threads controlled by the cable 201 shown in solid line. All other heddles must be in the lower shed position. In the same way the shuttle 112 must fine the heddles connected with the cable 202 shown in dotted line in the upper shed and all others in the lower shed position, etc. During the movement of a shuttle, the patterning of the warp threads associated with it is retained.

Thus at the place of the shuttle 111 the cable 201 and at the place of the shuttle 112 the cable 202, etc., must simultaneously be in the upper shed position. For this purpose, the drive points 271, 272 of these cables are connected with arms 621, 622 present on the maximally swung rotation shaft 631. This rotation shaft 631 is driven by the cam 651. In this way all drive points of the cable 20 which carry out the same movement are driven by a cam. The cable 201 must be in upper shed position at the place of the shuttle 111 and in lower shed position at the place of the three preceding shuttles. It can be seen from FIG. 7 that these conditions are satisfied with the arrangement of the cams 65 shown.

It is furthermore clear that the arrangement of the cams 65 shown in the drawings has the result that the movement into the upper shed position takes place in the correct sequence at any given place, for instance at the place of the shuttle 111 shown in the drawing, and that following the upper shed position of the cable 201 there take place the movement of the dash-dot cable, then that of the dotted line cable and finally that of the dashed line cable.

The scope of use of this traveling shed is not limited merely to four heddle rows. One typical embodiment consists of six heddle rows whereby all fundamental weaves up to the six-thread repeat can be produced. The number of required treading cams 65 and rotary shafts 63 is always twice the thread repeat and in this case 12 instead of 8 (as in the example of FIG. 7).

Due to the existing continuity of the sinusoidal curve into which the flexible cables 20 are deformed, their total length remains constant in operating condition. However, lateral travel can take place. This is prevented by having all cables on one side protrude by approximately one-half wavelength 70 (referred to the wave shape of the cables 20) and rigidly clamping them there in correct position with respect to the divisions in a fastening block 71. Outside the fastening block 71 any desired length of the flexible cables 20 can be provided as replacement storage in a storage means 72. After the loosening of the fastening 71, these replacement cables can be pulled in new if necessary without removing the heddle block.

Figure 8:
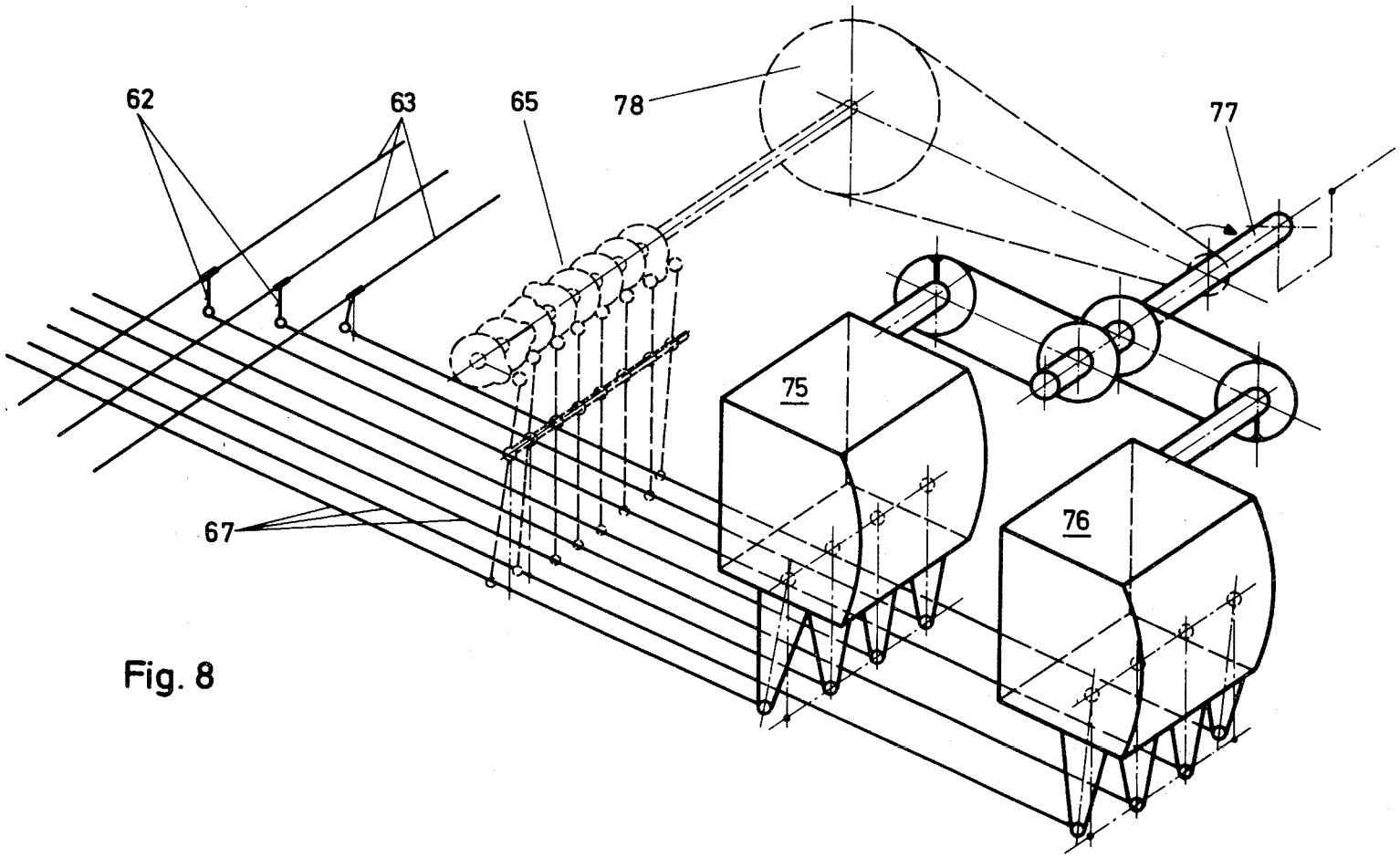
FIG. 8 is a diagrammatic illustration showing the drive of a shed forming device in accordance with the invention.

It is of course generally known in the field of weaving that a treading cam or crank arrangement 65 or 31 respectively can always be replaced by a dobby. This will be explained in a special example with reference to FIG. 8. The treading cam set 65 can be replaced by two separately driven dobbies 75 and 76. The weave repeats in the case of the dobbies 75, 76 must be identical. The dobbies 75, 76 are driven from the main shaft 77 of the loom. The dobby 76 must however lag half a loom revolution (180°) behind the dobby 75. The drive for the treading cam set on the other hand is effected from the main shaft via the wheel 78 and is reduced in the case of the 1/3 weave by the instance 1:4. One revolution of the machine always corresponds to half a sinusoidal cycle (shuttle division 12).

The step-down ratio is thus equal to the number of threads in the weave repeat. The drive of the dobby is also effected from the main shaft 77 but in a ratio of 1:1. One revolution of the machine in this case also corresponds to half a sinusoidal cycle (shuttle division 12).

It will be appreciated that various changes and/or modifications may be made within the skill of the art without departing from the spirit and scope of the invention illustrated, described, and claimed herein.

What is claimed is:

1. A shed forming device on an undulated shed loom in which during operation sheds are formed one after the other in a sinusoidal movement and shed forming heddles are arranged along flexible cables and held by them, and the flexible cables during the operation of the loom carry out a sinusoidally advancing movement for the production of which drive points arranged spaced apart from each other are provided on each of said cables, there being provided operational members extending in the width-wise direction of the loom, each operational member being operatively coupled to drive points of one of the corresponding flexible cables by a coupling means, for each cable there being provided individually movable operational members while lie parallel to each other in a single plane and which are of straight, elongate and rod-like shape, each of said operational members being driven by an individual driving means.

2. The shed forming device according to claim 1 in which each of said cables is of round cross-section and the shed forming heddles have recesses therein which surround a cable over less than its total circumference.

3. The shed forming device according to claim 1 in which rotating cam members move the operational members which extend in the width-wise direction and in reference to the sinusoidal shape of the cables drive points the drive points have a phase difference of 90° in their movements are driven by said members, said cam members being shifted in phase by an amount equal to $180°/n$ where $n$ is the number of threads present per weave repeat and the cam members carry out one full revolution for $n$ revolutions of the main shaft of the loom.

4. The shed forming device according to claim 1 in which cable holding means is provided on at least one side of the loom for holding the cables fast to the loom, and the distance between the point of emergence of the cables from the weaving heddles and the point of the holding of them is at least approximately equal to one shuttle division.

5. The shed forming device according to claim 1 in which a storage means is provided and the cables are continued on one side of the loom to said storage means from which they can be removed to replace cables which have become worn from use.

6. The shed forming device according to claim 1 in which flat guide elements are arranged parallel to the direction of movement of the shed forming heddles between which the heddles are located, said guide elements having cable bearing slots which extend parallel to the direction of movement of the heddles and are aligned with each other, through which slots said flexible cables are positioned and guided, and said guide elements having further operational member slots extending parallel to the direction of movement of the heddles and aligned with each other, the operational members in the form of rails are positioned in said slots by which they are guided in a movement of translation taking place parallel to themselves, each drive point being coupled by means of a connecting rod with a rail and having connecting rods in the immediate vicinity of rails lying in the same plane.

7. The shed forming device according to claim 6 which has at least one guide rod for the weaving heddles said guide rods being held in the guide elements by openings aligned with each other and by which the heddles are guided by fork-shaped arms extending towards their one end, said arms resting against opposite sides of the guide rod.

8. The shed forming device according to claim 6 in which the connecting rods form a sliding guide on one end for one of the cables and are held at the other end by an opening on a rail, said connecting rods having a longitudinal slot through which a part of the rails which are arranged in the same plane is freely movable back and forth.

9. The shed forming device according to claim 1 in which each of the flexible cables is a metal rope having an outer plastic jacket, the plastic jacket lies adjacent to the outer surface of the metal rope but does not adhere thereto.

10. A shed forming device on an undulated shed loom in which during operation sheds are formed one after the other in a sinusoidal movement and shed forming heddles are arranged along flexible cables and held by them, and the flexible cables during the operation of the loom carry out a sinusoidally advancing movement for the production of which drive points arranged spaced apart from each other are provided on each of said cables, there being provided operational members extending in the widthwise direction of the loom, each operational member being operatively coupled to drive points of one of the corresponding flexible cables by a coupling means, for each cable there being provided individually movable operational members which lie parallel to each other in a single plane and which are of straight, elongate and rod-like shape, the operational members being rotary shafts operatively associated with the different cables and lying in the same plane, each of the rotary shafts adapted to carry out swinging movements by a drive means, a double armed lever coupling each of said drive points with the drive means, and by the dimensioning of the lengths of the two arms of the double armed lever, the movements of the drive points take place in the manner that with an increase in the distance between the flexible cable and the place of beating-up of the cloth, the paths of movement of the drive points become larger.

11. The shed forming device according to claim 10 in which the flexible cables are in planes lying parallel to each other and carry out their movements in said planes, connecting rods arranged parallel to said planes and guiding to drive points of said cables are present, being connected to the end in each case of one arm of the double-armed levers arranged perpendicular to said planes, the pivot points of the double-armed levers lying in a straight line parallel to the planes and the other arms of the double-armed levers being of the same length.

12. A shed forming device on an undulated shed loom in which during operation sheds are formed one after the other in a sinusoidal movement and shed forming heddles are arranged along flexible cables and held by them, and the flexible cables during the operation of the loom carry out a sinusoidally advancing movement for the production of which drive points arranged spaced apart from each other are provided on each of said cables, there being provided operational members extending in the width-wise direction of the loom, each operational member being operatively coupled to drive points of one of the corresponding flexible cables by a coupling means, for each cable there being provided individually movable operational members which lie parallel to each other in a single plane and which are of straight, elongate and rod-like shape, and in which at least two conventional dobbies drive the operational members extending in the width-wise direction, said conventional dobbies controlled with the same program but with a phase difference of 180°, and in reference to the sinusoidal shape of the cables, the drive points of the cables, which points follow each other with a phase difference of 90° in their movements, are driven by the successive rockers of the dobby and alternately with the one and the other dobby whereby a sequence movement is produced which follows a pattern of first rocker of the first dobby, first rocker of the second dobby, second rocker of the first dobby, second rocker of the second dobby, and so forth.

13. The shed forming device according to claim 9 in which the plastic jacket encases the metal rope with a lubricant and anti-rust agent sealed within the plastic jacket.

* * * * *